US010843454B2

(12) United States Patent
Larson

(10) Patent No.: US 10,843,454 B2
(45) Date of Patent: Nov. 24, 2020

(54) ENDURANCE FABRIC MESH PANEL FOR SILK SCREENING

(71) Applicant: James D. Larson, Snohomish, WA (US)

(72) Inventor: James D. Larson, Snohomish, WA (US)

(73) Assignee: JSMD Key Products, LLC, Monroe, WA (US)

( * ) Notice: Subject to any disclaimer, the term of this patent is extended or adjusted under 35 U.S.C. 154(b) by 59 days.

(21) Appl. No.: 15/872,839

(22) Filed: Jan. 16, 2018

(65) Prior Publication Data

US 2019/0217599 A1 Jul. 18, 2019

(51) Int. Cl.

| | |
|---|---|
| ***B41F 15/36*** | (2006.01) |
| ***B41C 1/14*** | (2006.01) |
| ***B41N 1/24*** | (2006.01) |

(52) U.S. Cl.

CPC ..... *B41F 15/36* (2013.01); *B41C 1/14* (2013.01); *B41N 1/248* (2013.01)

(58) Field of Classification Search

CPC ..... B41F 15/34; B41F 15/36; B41C 1/14
See application file for complete search history.

(56) References Cited

U.S. PATENT DOCUMENTS

| | | | | |
|---|---|---|---|---|
| 3,805,873 | A * | 4/1974 | Bloomfield | B44C 7/022 160/392 |
| 4,186,043 | A * | 1/1980 | Zeigler, Jr. | A41D 27/245 156/202 |
| 4,251,312 | A * | 2/1981 | Ziegler, Jr. | A41D 27/245 156/465 |
| 5,606,911 | A * | 3/1997 | Cane | B41F 15/36 101/127 |
| 6,103,427 | A * | 8/2000 | Storm | G03F 7/70866 428/14 |
| 6,579,403 | B2 * | 6/2003 | Tolbert | A41D 27/245 156/291 |
| 8,286,552 | B2 | 10/2012 | Niswonger | |
| 9,427,952 | B2 | 8/2016 | Larson | |
| 2003/0004076 | A1 * | 1/2003 | Barrington | B41M 1/12 510/177 |
| 2008/0022868 | A1 * | 1/2008 | Kasuya | B41F 15/36 101/127.1 |
| 2009/0145559 | A1 * | 6/2009 | Glasl | B60J 1/2041 160/273.1 |

(Continued)

FOREIGN PATENT DOCUMENTS

| | | | | |
|---|---|---|---|---|
| GB | 2364961 | * | 2/2002 | H05K 3/1225 |

*Primary Examiner* — Matthew G Marini
*Assistant Examiner* — Marissa Ferguson-Samreth
(74) *Attorney, Agent, or Firm* — Clark A. Puntigam; Jensen & Puntigam, P.S.

(57) ABSTRACT

A fabric mesh panel having a print area and a perimeter mesh area, the perimeter mesh area having folded-back edge portions which are adhesively attached to a remainder of the perimeter mesh area. The folded-back edge portions have stress relieving cuts extending from a termination edge back toward edge pockets defined by the mesh edge portions. Continuous adhesive strips extend around the fabric mesh panel on the top and bottom surfaces of the mesh panel, overlapping the termination edge of the folded back edge portion on the top surface of the mesh panel and in approximate registry therewith on the bottom surface of the mesh panel.

20 Claims, 5 Drawing Sheets

(56) References Cited

U.S. PATENT DOCUMENTS

| | | | | |
|---|---|---|---|---|
| 2009/0217831 | A1* | 9/2009 | Cane | B41F 15/36<br>101/126 |
| 2014/0209360 | A1* | 7/2014 | Peng | H05K 1/028<br>174/254 |

* cited by examiner

ENDURANCE FABRIC MESH PANEL FOR SILK SCREENING

TECHNICAL FIELD

This invention relates generally to silk screening and more particularly to arrangements of fabric mesh panels used in silk screening.

BACKGROUND OF THE INVENTION

Some known mesh panels used for silk screening include edge pockets which do not meet at the corners of the mesh panels, i.e. open corners. The open corners reduce tension, promote fraying and possible tearing of the mesh at the corners when the mesh is put under tension in a silk screen frame. Additional support is usually needed to maintain the overall tension and stability of the mesh panel with such an arrangement. Further, many other current arrangements, and particularly those with open corners, do not have a continuous boundary relative to the printing area of the mesh, so that there is not a complete perimeter block-out for the print area of the mesh panel. These disadvantages are inconvenient for the user and can decrease the usefulness and life of individual mesh panels.

SUMMARY OF THE INVENTION

Accordingly the invention is a mesh panel assembly for use for silk screening, comprising a mesh panel which includes an open mesh area defining a printing area for silk screening, a perimeter mesh area for securing the mesh panel under tension to a silk screening frame, the perimeter area including a pocket along each edge of the mesh panel formed by folding an edge portion of the mesh panel back upon and bonded by an adhesive to a remainder of the perimeter mesh area, wherein each edge portion includes at least one slit opening or cut at positions along each edge, extending from a termination of the edge portion, wherein the termination of the edge portion is positioned to define an intermediate mesh area to the open mesh area; and an upper surface adhesive sealing strip which overlays the folded-back edge portions on an upper surface of the mesh panel and a lower surface adhesive sealing strip on the same area on the lower surface, the sealing strips extend over at least a portion of the intermediate mesh area, wherein the adhesive sealing strips are continuous around the mesh panel, providing a substantially complete perimeter block-out area for the open mesh area.

BEST MODE FOR CARRYING OUT THE INVENTION

Figure one shows a top view of a fabric mesh panel 10 of the present invention used for silk screening. The mesh panel 10 is supported by and tensioned to a surrounding frame 11 by elongated tension elements 15-15, which could be rods (FIG. 2A) or strips (FIG. 2B) or other elements, which extend along each edge of the mesh panel in edge pockets 13, the mesh panel in the present embodiment being rectangular in configuration, although other configurations can be used.

Figure 1:
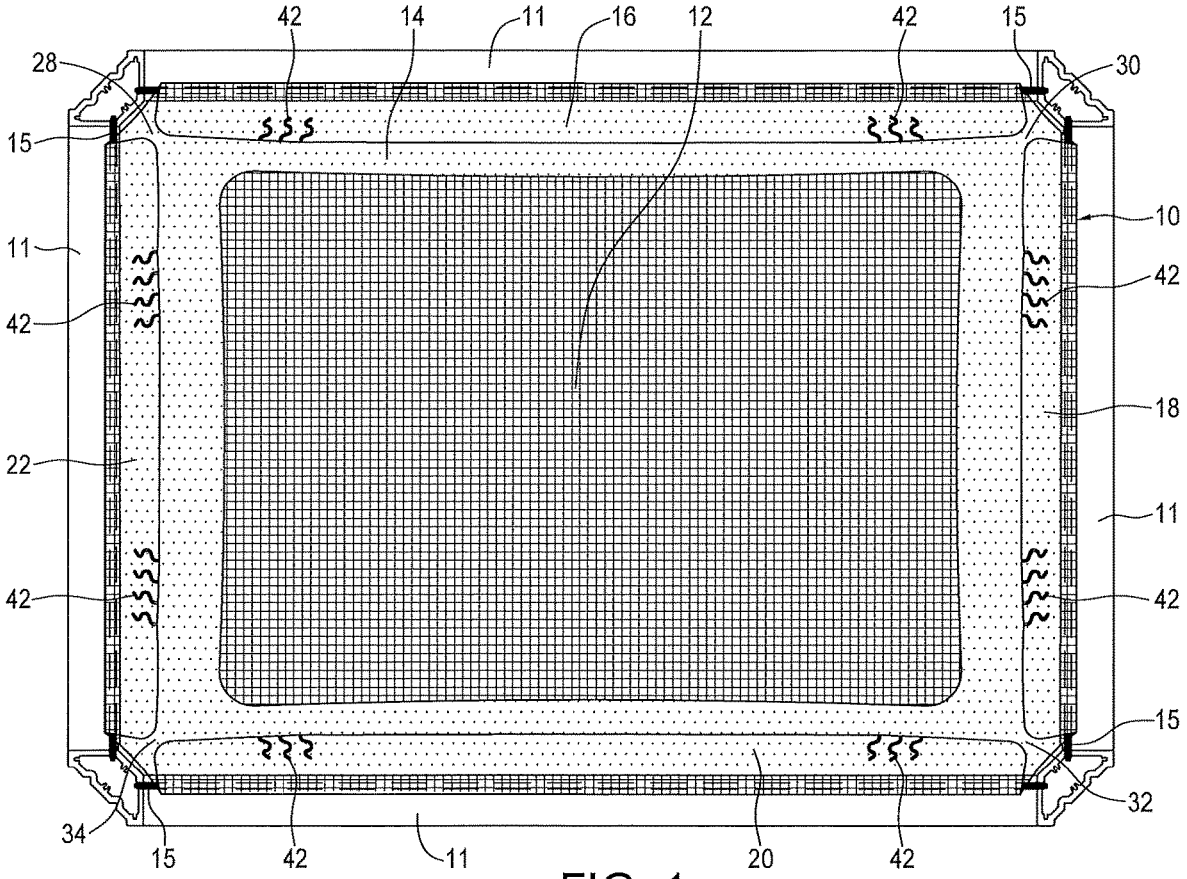
FIG. 1 is a top view of the fabric mesh panel of the present invention.
Figure 5:
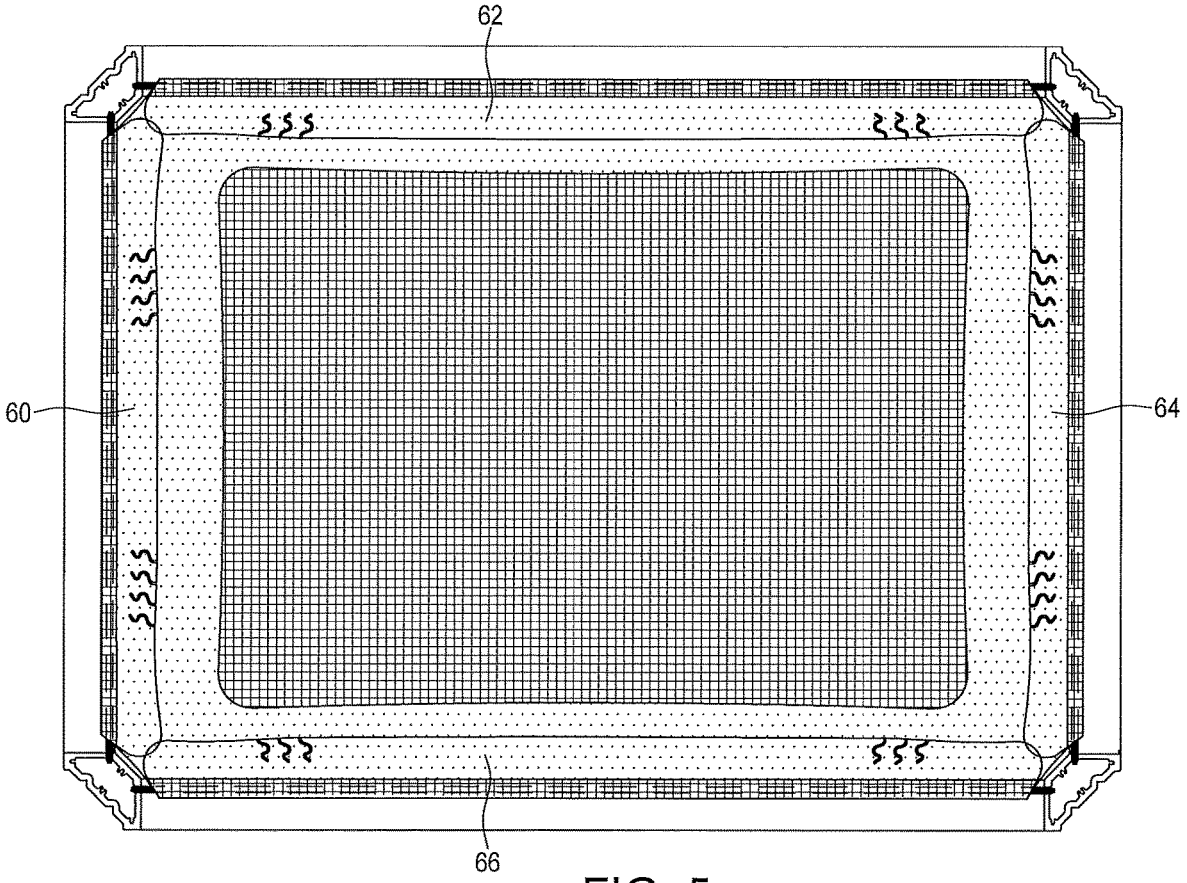
FIG. 5 is an alternative arrangement to FIG. 1.

The mesh panel 10 is a conventional silk screening mesh fabric identified commercially as polyester silk screening mesh, or similar material. The mesh panel 10 has a mesh print area 12 with a perimeter area 14 surrounding the mesh print area. The perimeter area includes edge portions 16, 18, 20 and 22 which extend respectively along each edge of the mesh panel and are folded back onto the remainder of the perimeter area 14. The edge portions are attached to the remainder of the perimeter area by an adhesive or other means, such as stitching. The folded back edge portions define pockets 13-13 along each edge to accommodate the tension elements 15-15. Typically, the width of the folded back edge portions is approximately 1¼ inches, although this can be varied, e.g. ½ to 2 inches. The folded back edge portions in some arrangements do not extend for the entire length of each edge, leaving open corner portions 28, 30, 32 and 34, as shown in FIG. 1, or in other arrangements extend sufficiently that the folded back edge portions 60, 62, 64, 66, overlap slightly at the corners, as shown in FIG. 5. The overlap supports corner tensioning, helping to prevent corner breakage or tears.

The present invention includes several stress relief cuts, typically positioned along each edge. These cuts or slits extend from the terminating edge 38 of each folded back edge portion in the direction of the pocket along each edge, although not into the pocket area. The stress relief cuts are referenced generally at 42-42, referring to FIG. 1. The stress relief cuts are highly advantageous, as they permit the tension rod or strip to fit into a curved pocket and to otherwise relieve the tension along the edges of the mesh fabric portions. The mesh can be folded on a curve (FIG. 3) without wrinkling or distorting the perimeter mesh portion while maintaining sufficient tension of the mesh for high quality printing. Typically but not necessarily, the width of the stress relief cuts will be somewhat larger at the terminating edge of the folded back edge portions, narrowing as they proceed toward the pocket, having a straight line length of ¼ inch-2 inches, although this can be varied.

The stress relief cuts will typically be along each edge portion, typically but not necessarily in two separate areas of each edge. For example, referring to FIG. 3, one or more stress relief cuts 45-45 can be positioned approximately around the point 47 of each half of an edge 46 where the curved section 49 of the folded back edge portion meets the approximately straight portion 51 thereof. The curved edges of the mesh produced by the tension elements on the frame are important to place the mesh under the tension necessary to create a good print area. The number of the stress relief cuts can vary; one relief cut is possible, although a plurality, such as three or four stress relief cuts, is generally preferred.

Figure 3:
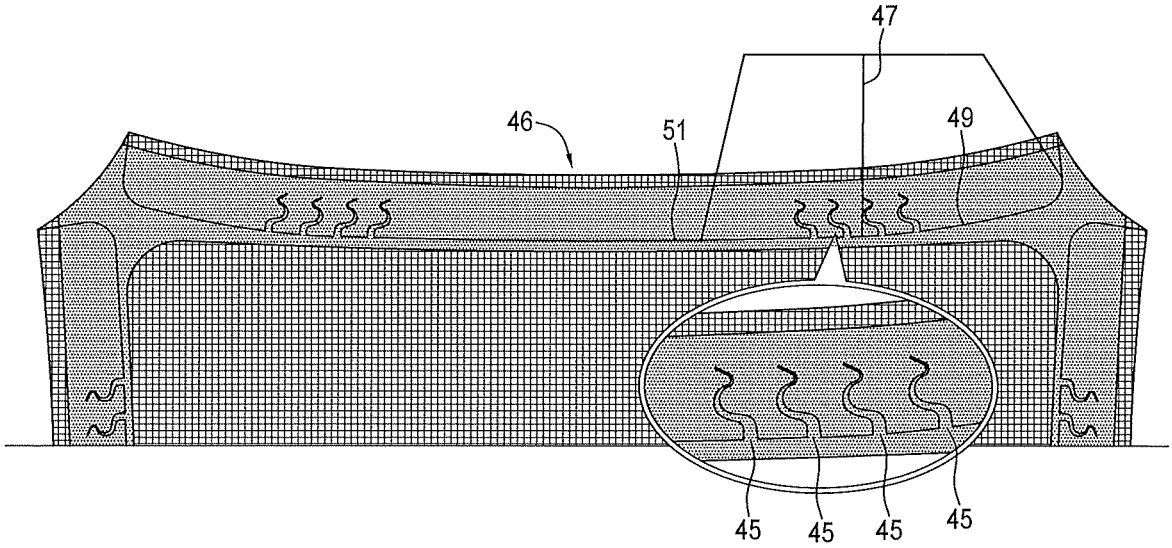
FIG. 3 is a top view of stress relief cuts in a mesh panel to conform to a curve.
Figure 4A:
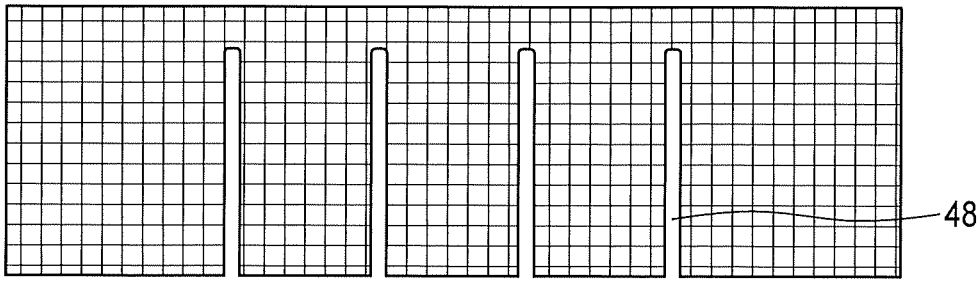
FIG. 4A is one example of a stress relief cut in the fabric mesh panel of FIG. 1.
Figure 4B:
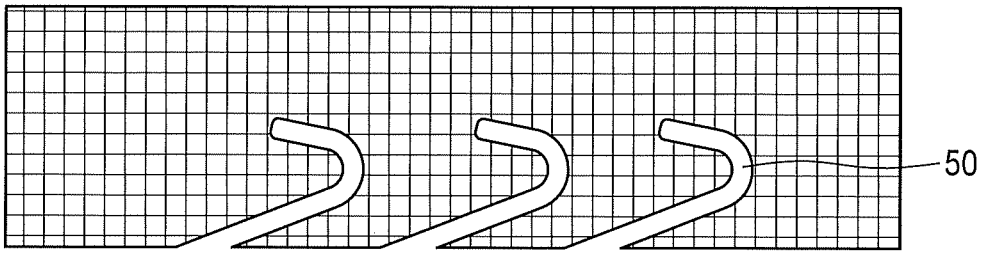
FIG. 4B is another example of a stress relief cut.
Figure 4C:
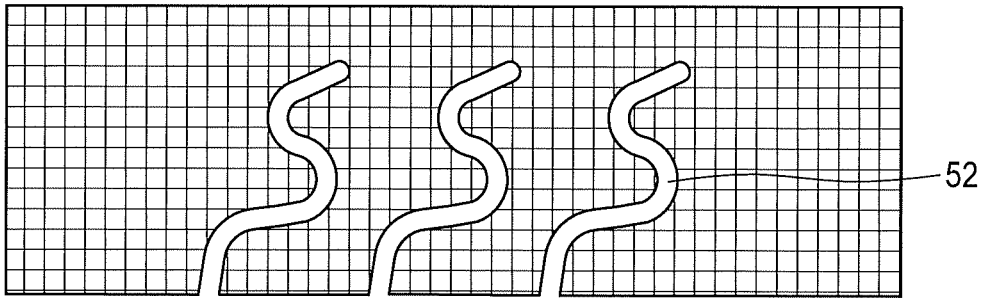
FIG. 4C is a further example of a stress relief cut.
Figure 4D:
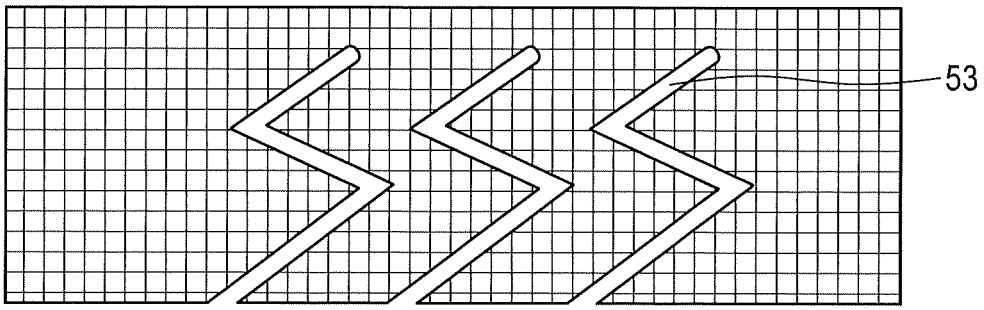
FIG. 4D is a still further example of a stress relief cut.

As shown in FIG. 3, the stress relief cuts self adjust to conform to the desired curve of the edge 46. Other stress relief cut configurations are shown in FIGS. 4A-4D. 4A shows a plurality of straight line stress relief cuts 48-48 from the terminating edge of the edge portion. They could be angled as well. FIG. 4B shows another example of a stress relief cut 50-50 in a hook like shape. FIG. 4C shows an S-shaped stress relief cut arrangement 52-52 similar to that of FIG. 3, while FIG. 4D shows a zigzag arrangement 53-53. It should be understood that other stress relief cut shapes can be used. The cuts, however, must extend from the terminating edge 38 of the folded back edge portion back a selected distance toward the pocket along each edge, usually ¼ inch-2 inches.

Figure 2A:
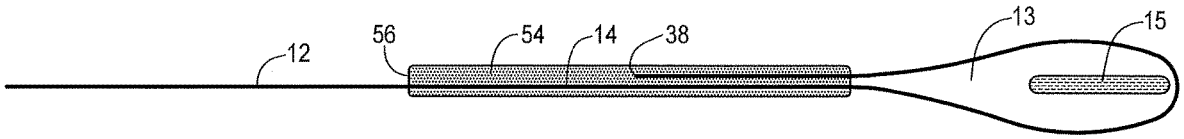
FIG. 2A is a cross-sectional view of a portion of the mesh panel of FIG. 1.
Figure 2B:
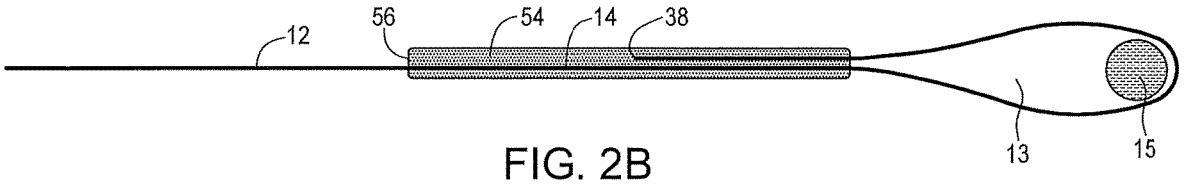
FIG. 2B is an alternative arrangement from FIG. 2A

Referring to FIGS. 2A, 2B (not shown in FIG. 1 for clarity), an adhesive sealing strip 54 is positioned continuously around an interior perimeter of the mesh fabric, overlapping a portion of the folded back edge portions and extending to a boundary edge 56 of the open mesh area 12. The adhesive sealing strip 54 contacts the edge portions and the mesh fabric between the pockets defined by the folded back edge portions and the boundary edges of the print area, sealing off the mesh between the termination of the edge portions and the print area and in effect providing a liquid block out of that area, in addition strengthening and stabilizing the mesh and preventing tears from normal use. An adhesive sealing strip is provided on both the upper and the lower surfaces of the fabric mesh, providing an effective liquid, including ink, barrier on both surfaces, preventing liquid from reaching the folded back edge portions.

In the process of screen printing, emulsion is spread over the mesh and seals the mesh openings; the emulsion is photosensitized or the emulsion is exposed and then washed to produce the design. The adhesive sealing strip provides a surface for the emulsion to seal to, which seals the perimeter mesh, completing the perimeter block out of the mesh. The adhesive sealing strip extends fully and continuously around the entire interior perimeter of the fabric section including the four corners, providing a complete perimeter block-out. The extended adhesive, from the pocket of each edge to the boundary edges of the print area significantly reduces the possible elongation of the mesh during use and improves protection of the mesh. These are significant advantages provided by the sealing strip to the life or the production provided by the mesh. As discussed above, the stress relief cut lines allow the mesh to extend or be folded along a curve, as well as providing stress relief for the mesh along each edge. The block-out provided by the adhesive strip seals the mesh openings, preventing liquid from penetrating the screen mesh beyond the print area.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A mesh panel assembly for silk screening, comprising:

a mesh panel having panel edges and corners, the mesh panel including an open mesh area defining a printing area for silk screening, a perimeter mesh area for securing the mesh panel under tension to a silk screening frame, the perimeter mesh area including an edge pocket along each panel edge of the mesh panel formed by folding an edge portion of the mesh panel back upon and bonding by an adhesive to a remainder of the perimeter mesh area, defining folded-back edge portions, wherein each folded-back edge portion includes at least one continuous slit opening extending from a termination edge of the folded-back edge portion toward the edge pocket, but not into the edge pocket, wherein the termination edge of the folded-back edge portion is positioned so as to define an intermediate mesh area relative to the open mesh area.

2. The mesh panel assembly of claim 1, including an adhesive sealing strip that overlays and seals an upper surface of the mesh panel and a lower surface of the mesh panel, the adhesive sealing strip extending over at least a portion of the intermediate mesh area, wherein the adhesive sealing strip is continuous around the mesh panel, forming a substantially complete perimeter block-out area on both the upper and lower surfaces of the mesh panel.

3. The mesh panel assembly of claim 2, wherein the adhesive strip sealing strip overlays the folded-back edge portions on the upper surface of the mesh panel.

4. The assembly of claim 1, including a rod or other fastening member positioned in the edge pocket along each edge of the mesh panel and supported by the silk screening frame to provide tension to the mesh panel.

5. The assembly of claim 1, wherein the at least one continuous slit opening is a stress relieving cut.

6. The assembly of claim 1, wherein the at least one continuous slit opening is vertical.

7. The assembly of claim 1, wherein the at least one continuous slit opening is in the form of an s.

8. The assembly of claim 1, wherein the at least one continuous slit opening is in the form of a hook.

9. The assembly of claim 1, wherein the at least one continuous slit opening is in the form of a zig zag.

10. The assembly of claim 1, including at least two continuous slit openings at two spaced locations along each termination edge.

11. The assembly of claim 1, including a plurality of continuous slit openings at each of two spaced locations along each termination edge.

12. The assembly of claim 1, wherein the folded-back edge portions are approximately ½- 2 inches wide.

13. The assembly of claim 1, wherein the at least one slit opening is approximately ¼- 2 inches long.

14. The assembly of claim 1, wherein the folded back edge portions overlap at the corners of the mesh panel.

15. The assembly of claim 1, wherein the folded back edge portions do not overlap at the corners of the mesh panel.

16. A mesh panel assembly for use for silk screening, comprising:

a mesh panel having panel edges and corners, the mesh panel including an open mesh area defining a printing area for silk screening, a perimeter mesh area for securing the mesh panel under tension to a silk screening frame, the perimeter mesh area including a pocket along each edge of the mesh panel formed by folding an edge portion of the mesh panel back upon and bonding by an adhesive to a remainder of the perimeter mesh area, defining a folded-back edge portion for each panel edge;

an adhesive sealing strip that overlays and seals the upper surface and lower surface of the mesh panel, wherein the sealing strip on the upper surface overlays the folded-back edge portion on the upper surface of the mesh panel, the adhesive sealing strip is continuous around the mesh panel, forming a liquid block-out area of the open mesh area on both the upper and lower surfaces of the mesh panel.

17. The assembly of claim 16, wherein the sealing strip on the upper surface extends to a boundary edge of the printing area.

18. The assembly of claim 16, including a rod or other fastening member positioned in the edge pocket along each edge of the mesh panel and supported by the silk screening frame to provide tension to the mesh panel.

19. The assembly of claim 16, wherein the folded back edge portions overlap at the corners of the mesh panel.

20. The assembly of claim 16, wherein the folded back edge portions do not overlap at the corners of the mesh panel.

* * * * *